US012162716B2

(12) United States Patent
Wright, III et al.

(10) Patent No.: US 12,162,716 B2
(45) Date of Patent: Dec. 10, 2024

(54) DYNAMIC TENSION CONTROL SYSTEM FOR NARROW FABRIC

(71) Applicant: Flynt Amtex, Inc., Burlington, NC (US)

(72) Inventors: James Austin Wright, III, Trinity, NC (US); Ray Hugh Baynard, Jr., Trinity, NC (US)

(73) Assignee: FLYNT AMTEX, INC., Burlington, NC (US)

( * ) Notice: Subject to any disclaimer, the term of this patent is extended or adjusted under 35 U.S.C. 154(b) by 632 days.

(21) Appl. No.: 17/512,152

(22) Filed: Oct. 27, 2021

(65) Prior Publication Data

US 2022/0185618 A1 Jun. 16, 2022

Related U.S. Application Data

(60) Provisional application No. 63/124,415, filed on Dec. 11, 2020.

(51) Int. Cl.
*B65H 59/38* (2006.01)
*B65H 57/06* (2006.01)

(52) U.S. Cl.
CPC ..... *B65H 59/387* (2013.01); *B65H 57/06* (2013.01); *B65H 2513/23* (2022.08); *B65H 2701/31* (2013.01)

(58) Field of Classification Search
CPC ..... B65H 59/387; B65H 59/38; B65H 57/06; B65H 2512/23; B65H 2701/31;
(Continued)

(56) References Cited

U.S. PATENT DOCUMENTS 5,031,847 A * 7/1991 Tanaka ..... H01B 13/0003 226/118.3
5,318,234 A * 6/1994 Biggs ..... B65H 63/086 242/420.6

(Continued)

FOREIGN PATENT DOCUMENTS

CN 108483129 A 9/2018
CN 108840161 A 11/2018

(Continued)

*Primary Examiner* — Michael R Mansen
*Assistant Examiner* — Katelynne R Burrell
(74) *Attorney, Agent, or Firm* — Moore & Van Allen PLLC; R. W. McCord Rayburn

(57) ABSTRACT

A dynamic tension control system is described herein for driving linear material off a roll in a controlled manner. The dynamic tension control system may include a frame, a shaft for holding a roll of linear material, a motor for driving the shaft, and a dancer tensioning control system for controlling the motor. The dancer tensioning control system may include an actuator assembly through which the linear material passes and a proximity sensor for detecting whether the actuator assembly is proximate to the proximity sensor. When the linear material is pulled from the roll, tension is created in the linear material, which lifts the actuator assembly away from the proximity sensor. The dynamic tension control system may be configured to command, based on detecting that the actuator assembly is not proximate to the proximity sensor, the motor to drive the shaft to unwind linear material from the roll.

20 Claims, 7 Drawing Sheets

(58) Field of Classification Search
CPC .. B65H 59/36; B65H 2701/319; B65H 57/18; B65H 51/20; B65H 63/02; B65H 63/032; B65H 63/036
See application file for complete search history.

(56) References Cited

U.S. PATENT DOCUMENTS 5,810,236 A * 9/1998 Yoshida ..... B65H 20/34 226/118.3
5,906,330 A * 5/1999 Sand ..... B65H 59/36 242/417
5,988,553 A * 11/1999 Jonsson ..... B65H 59/36 242/417
6,068,171 A * 5/2000 Hill ..... H01L 24/78 226/97.1
6,237,383 B1 * 5/2001 Albert ..... B65H 59/36 242/417.3
6,340,126 B1 * 1/2002 McAlpine ..... B65H 59/387 242/603
6,381,993 B1 5/2002 Daiber
7,546,912 B1 6/2009 Pack et al.
9,856,106 B1 1/2018 Stewart et al.
10,385,484 B1 8/2019 Wyrick et al.
2014/0084101 A1 3/2014 Barea

FOREIGN PATENT DOCUMENTS

CN 113291926 A * 8/2021 ..... B65H 59/36
CN 114030939 A * 2/2022
EP 2868609 A1 * 5/2015 ..... B65H 59/36
EP 2868609 B1 3/2016
EP 2573026 B1 9/2017
KR 20220001761 A * 1/2022

* cited by examiner

DYNAMIC TENSION CONTROL SYSTEM FOR NARROW FABRIC

CROSS-REFERENCE TO RELATED APPLICATION

The present application claims the benefit of U.S. Provisional Application No. 63/124,415 for a "Dynamic Tension Control System for Narrow Fabric," filed Dec. 11, 2020, which is hereby incorporated by reference in its entirety.

FIELD OF THE INVENTION

The present invention embraces a dynamic tension control system for narrow fabric.

BACKGROUND

During the assembly of face masks (e.g., surgical masks, medical masks, and/or the like), an ear loop welding machine may be used to create and attach (e.g., weld) ear loops to a piece of mask fabric. For example, the ear loop welding machine may pull linear ear loop material from a roll of linear ear loop material, cut a section of the linear ear loop material, and weld the ends of the section of linear ear loop material onto a piece of mask fabric to form an ear loop.

SUMMARY

The following presents a simplified summary of one or more embodiments of the present invention, in order to provide a basic understanding of such embodiments. This summary is not an extensive overview of all contemplated embodiments and is intended to neither identify key or critical elements of all embodiments nor delineate the scope of any or all embodiments. This summary presents some concepts of one or more embodiments of the present invention in a simplified form as a prelude to the more detailed description that is presented later.

In one aspect, the present invention embraces a dynamic tension control system including a shaft for holding a roll of material (e.g., linear material), a motor for driving the shaft, and a dancer tensioning control system. The dancer tensioning control system may include an actuator assembly for receiving the material (e.g., with an eyelet) and a sensor (e.g., a proximity sensor). The sensor may be positioned below the actuator assembly. The sensor may be configured to detect whether the actuator assembly is proximate the sensor, transmit, based on detecting that the actuator assembly is not proximate the sensor, a signal, and stop transmitting, based on detecting that the actuator assembly is proximate the sensor, the signal. The dynamic tension control system may be configured to command, based on receiving the signal from the sensor, the motor to accelerate and command, based on stopping receiving the signal from the sensor, the motor to decelerate.

In some embodiments, the dynamic tension control system may include a frame configured for positioning and supporting the shaft, the motor, and the dancer tensioning control system.

In some embodiments, the dynamic tension control system may include a non-drive-side tube insert to position a spool of the roll such that the shaft passes through a center of the spool and a drive-side tube insert to position the spool of the roll such that the shaft passes through the center of the spool. Additionally, or alternatively, the non-drive-side tube insert may include a first attachment mechanism for attaching the non-drive-side tube insert to the shaft to prevent the non-drive-side tube insert and the roll from sliding off the shaft, and the drive-side tube insert may include a second attachment mechanism for attaching the drive-side tube insert to the shaft to prevent the drive-side tube insert and the roll from sliding off the shaft. In some embodiments, the non-drive-side tube insert may include a first conical portion, a first intermediate portion, and a first exterior portion, and the drive-side tube insert may include a second conical portion, a second intermediate portion, and a second exterior portion. Additionally, or alternatively, the first conical portion and the second conical portion may have lengthwise increasing outer diameters for receiving the spool, the first intermediate portion and the second intermediate portion may have outer diameters equal to or less than an inner diameter of the spool, and the first exterior portion and the second exterior portion may have outer diameters greater than an outer diameter of the spool.

In some embodiments, the dynamic tension control system may include one or more dancer tension control guides for receiving the material from the roll and providing the material to the dancer tensioning control system.

In some embodiments, the dynamic tension control system may include a user input device for controlling a top speed of the motor, acceleration of the motor, deceleration of the motor, a time period for which the motor drives the shaft, and/or the like.

In some embodiments, the dancer tensioning control system may include a top block assembly and an upper guide assembly extending outward from the top block assembly, where the material passes through the actuator assembly and then through the upper guide assembly. Additionally, or alternatively, the dancer tensioning control system may include a bottom block assembly, where the sensor is positioned on the bottom block assembly. In some embodiments, the dancer tensioning control system may include guide rods extending between the bottom block assembly and the top block assembly, where the actuator assembly moves along the guide rods.

In some embodiments, dynamic tension control system may include another shaft for holding another roll of material (e.g., linear material), another motor for driving the other shaft, and another dancer tensioning control system. The other dancer tensioning control system may include another actuator assembly for receiving (e.g., with another eyelet) the linear material from the other roll, another sensor (e.g., another proximity sensor), where the other sensor is configured to detect whether the other actuator assembly is proximate the other sensor, transmit, based on detecting that the other actuator assembly is not proximate the other sensor, another signal, and stop transmitting, based on detecting that the other actuator assembly is proximate the other sensor, the other signal. The dynamic tension control system may be configured to command, based on receiving the other signal from the other sensor, the other motor to accelerate and command, based on stopping receiving the other signal from the other sensor, the other motor to decelerate.

In another aspect, the present invention embraces a dynamic tension control system including a shaft for holding a roll of linear material, a motor for driving the shaft, and a dancer tensioning control system. The dancer tensioning control system may include a top block assembly, a bottom block assembly below the top block assembly, guide rods extending between the bottom block assembly and the top block assembly, an actuator assembly movably positioned on the guide rods between the bottom block assembly and the top block assembly, and a proximity sensor positioned on the bottom block assembly. The actuator assembly may include an eyelet for receiving the linear material. The proximity sensor may be configured to detect whether the actuator assembly is proximate the proximity sensor, transmit, based on detecting that the actuator assembly is not proximate the proximity sensor, a signal, and stop transmitting, based on detecting that the actuator assembly is proximate the proximity sensor, the signal. The dynamic tension control system may be configured to command, based on receiving the signal from the proximity sensor, the motor to accelerate and command, based on stopping receiving the signal from the proximity sensor, the motor to decelerate.

In some embodiments, the dancer tensioning control system may include an upper guide assembly extending outward from the top block assembly, where the linear material passes through the eyelet of the actuator assembly and then through the upper guide assembly.

In some embodiments, the dancer tensioning control system may include variable tensioners on the guide rods, where a position of the variable tensioners on the guide rods is adjustable to increase tension in the linear material when the actuator assembly reaches the position of the variable tensioners on the guide rods.

In some embodiments, the dancer tensioning control system may include adjustable mechanical upper limits on the guide rods, where a position of the adjustable mechanical upper limits on the guide rods is adjustable to provide a mechanical upper limit for the actuator assembly.

In some embodiments, the dancer tensioning control system may include a safety stop proximity sensor configured to detect whether the actuator assembly is proximate the safety stop proximity sensor and transmit, based on detecting that the actuator assembly is proximate the safety stop proximity sensor, another signal, and the dynamic tension control system may be configured to command, based on receiving the other signal from the safety stop proximity sensor, the motor to decelerate.

In yet another aspect, the present invention embraces a dynamic tension control system including a shaft for holding a roll of linear material, a motor for directly driving the shaft, a dancer tensioning control system, a frame for positioning and supporting the shaft, the motor, and the dancer tensioning control system, and a dancer tension control guide positioned on the frame. The dancer tensioning control system may include an actuator assembly and a proximity sensor positioned below the actuator assembly. The actuator assembly may include an eyelet for receiving the linear material. The proximity sensor may be configured to detect whether the actuator assembly is proximate the proximity sensor, transmit, based on detecting that the actuator assembly is not proximate the proximity sensor, a signal, and stop transmitting, based on detecting that the actuator assembly is proximate the proximity sensor, the signal. The dancer tension control guide may receive the linear material from the roll and provide the linear material to the dancer tensioning control system. The dynamic tension control system is configured to command, based on receiving the signal from the proximity sensor, the motor to accelerate and command, based on stopping receiving the signal from the proximity sensor, the motor to decelerate.

In some embodiments, the dancer tension control guide may include a dancer tension control L-guide and an eyelet, where the linear material passes through the eyelet, and where the eyelet includes a ceramic material.

In some embodiments, the dancer tensioning control system may include another dancer tension control guide for receiving the linear material from the dancer tension control guide.

The features, functions, and advantages that have been discussed may be achieved independently in various embodiments of the present invention or may be combined with yet other embodiments, further details of which may be seen with reference to the following description and drawings.

BRIEF DESCRIPTION OF THE DRAWINGS

Figure 1:
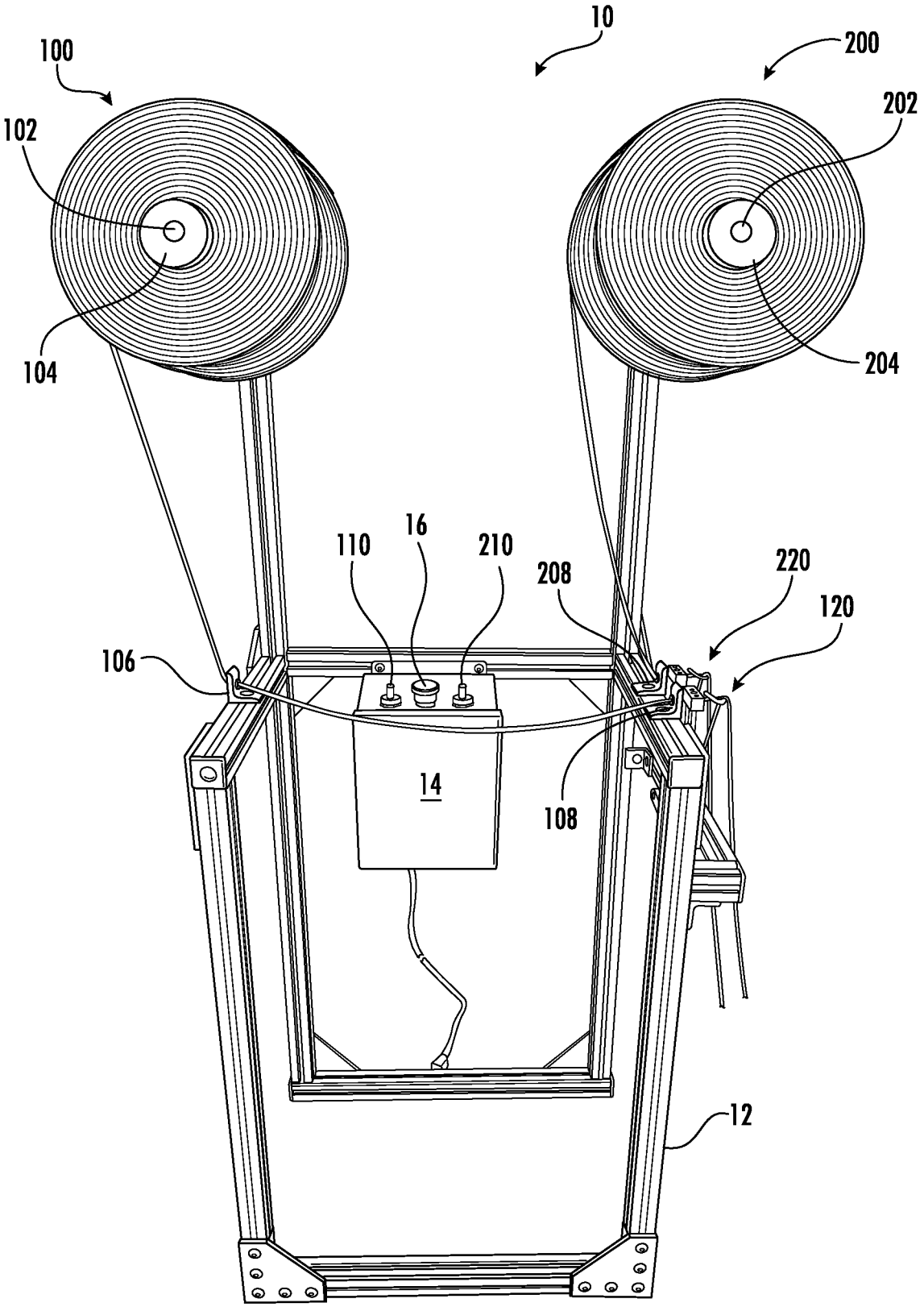
Figure 2A:
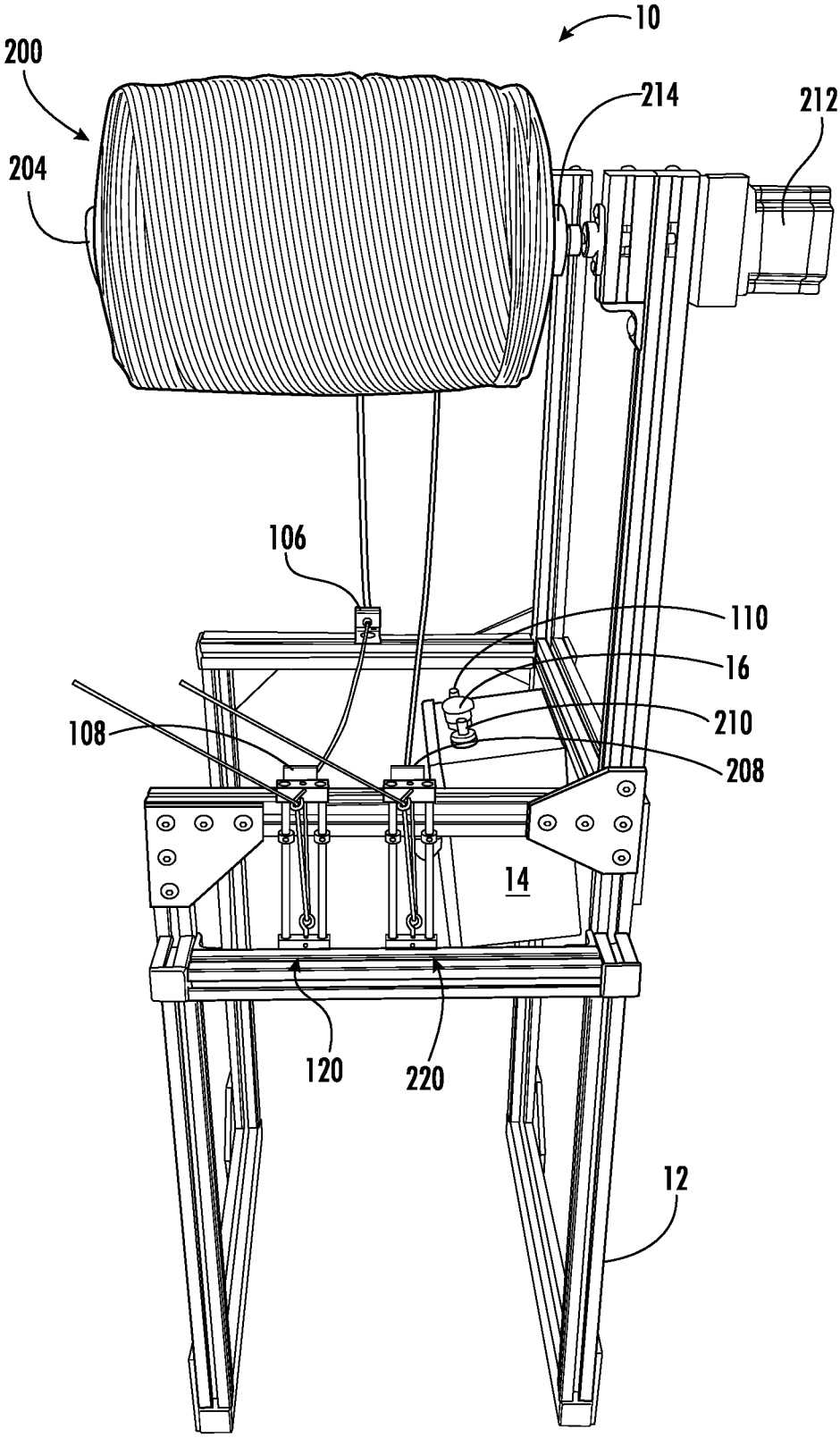
Figure 2B:
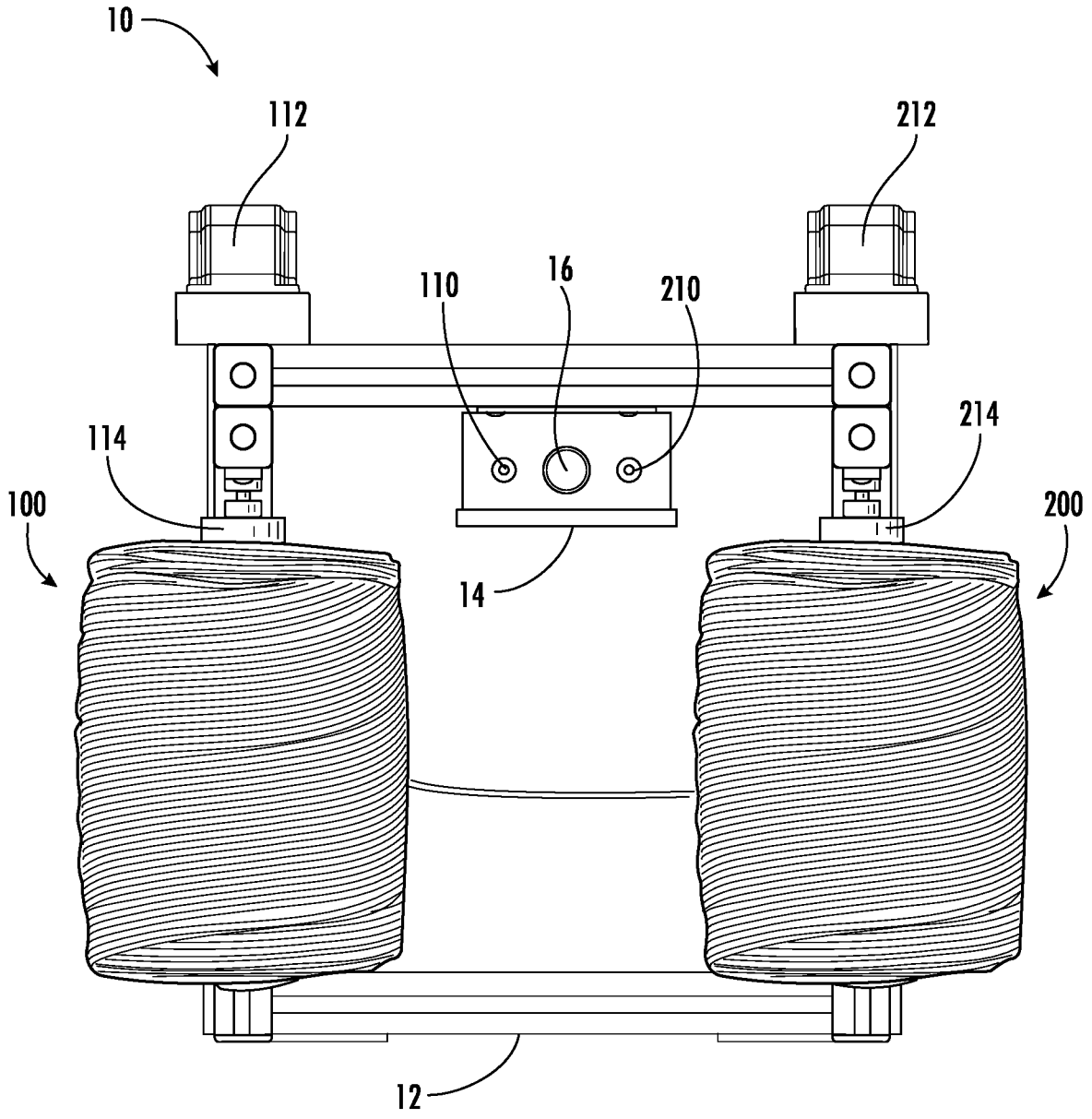
Figure 3:
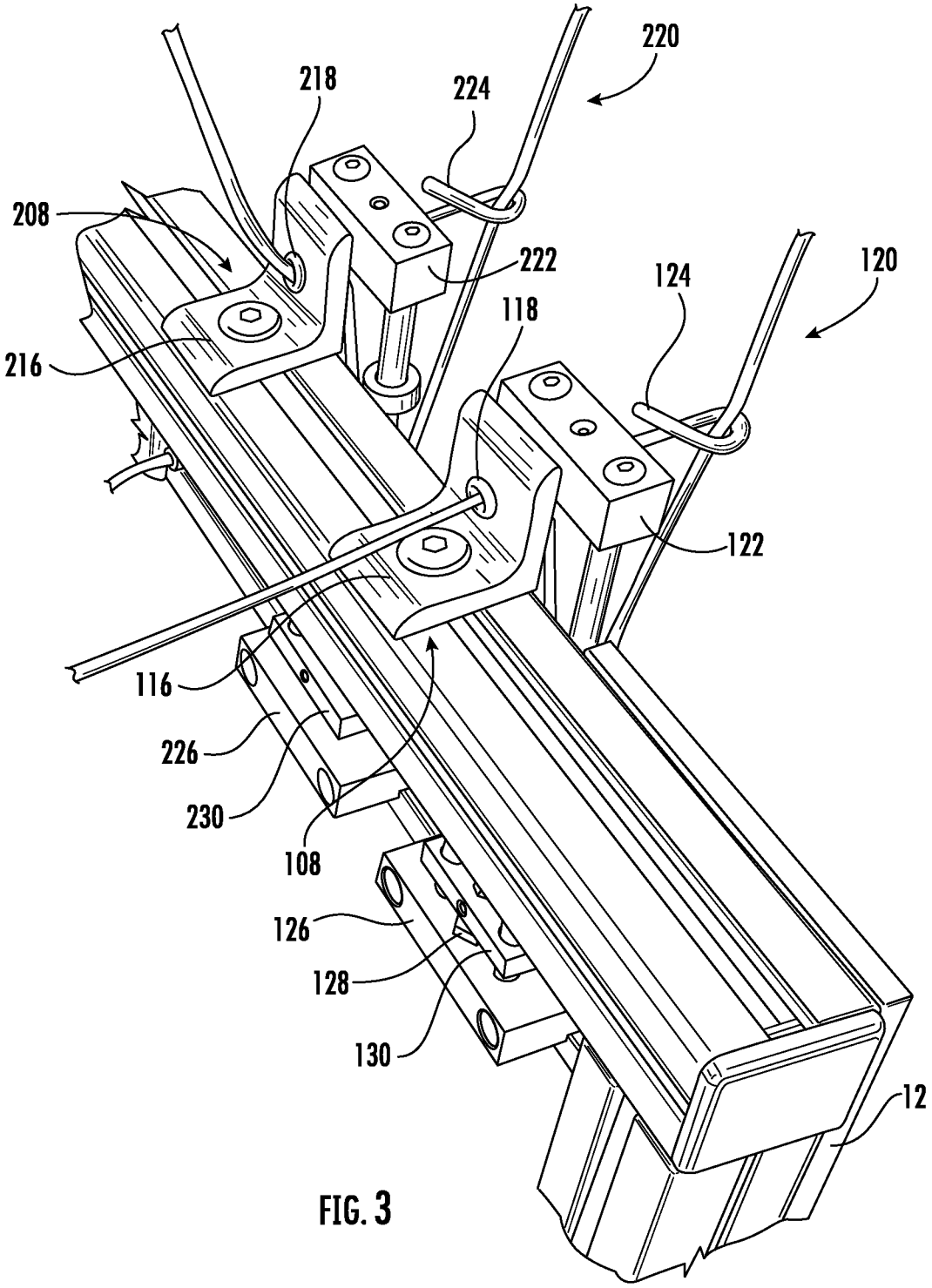
Figure 4:
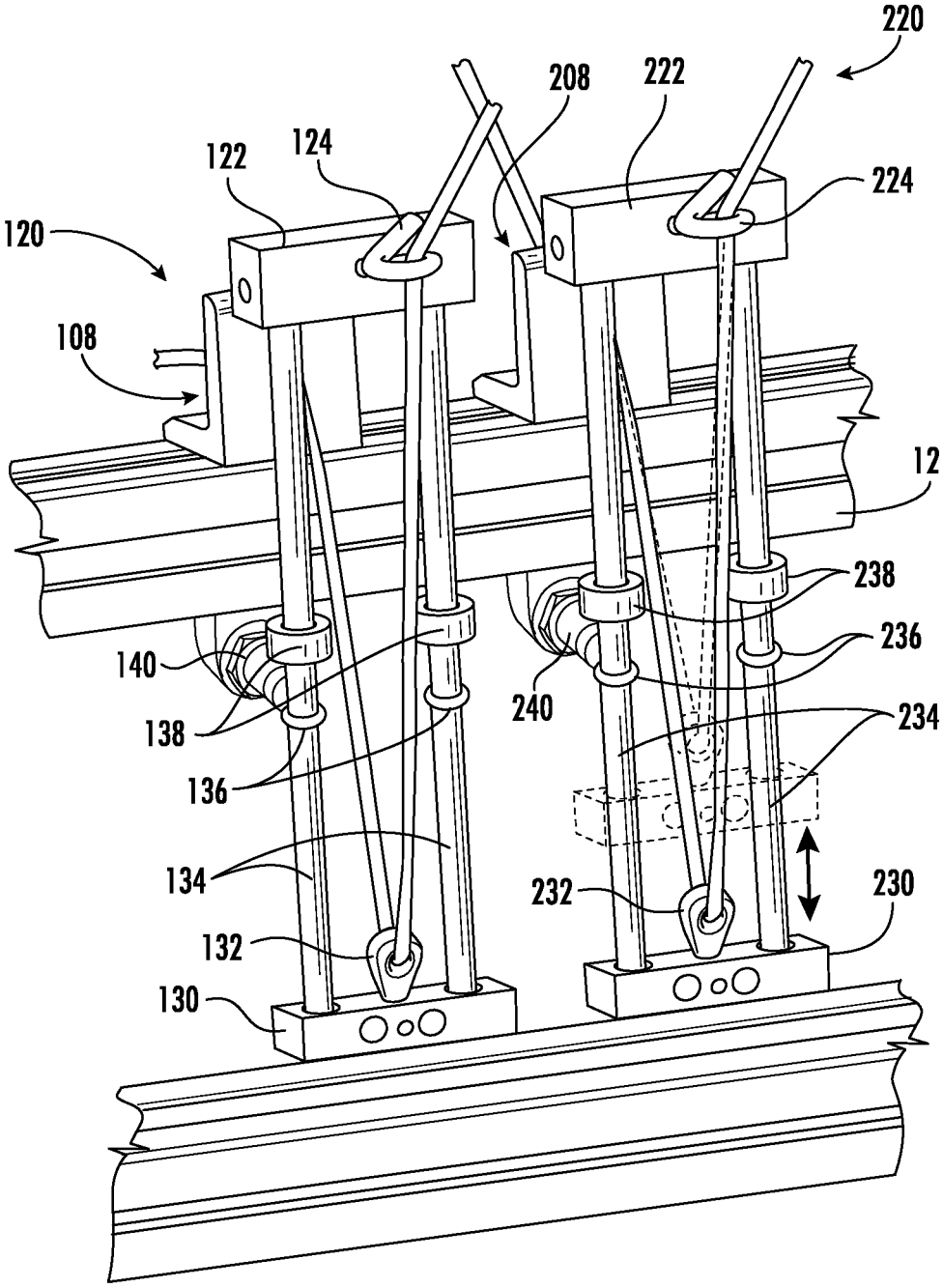
Figure 5:
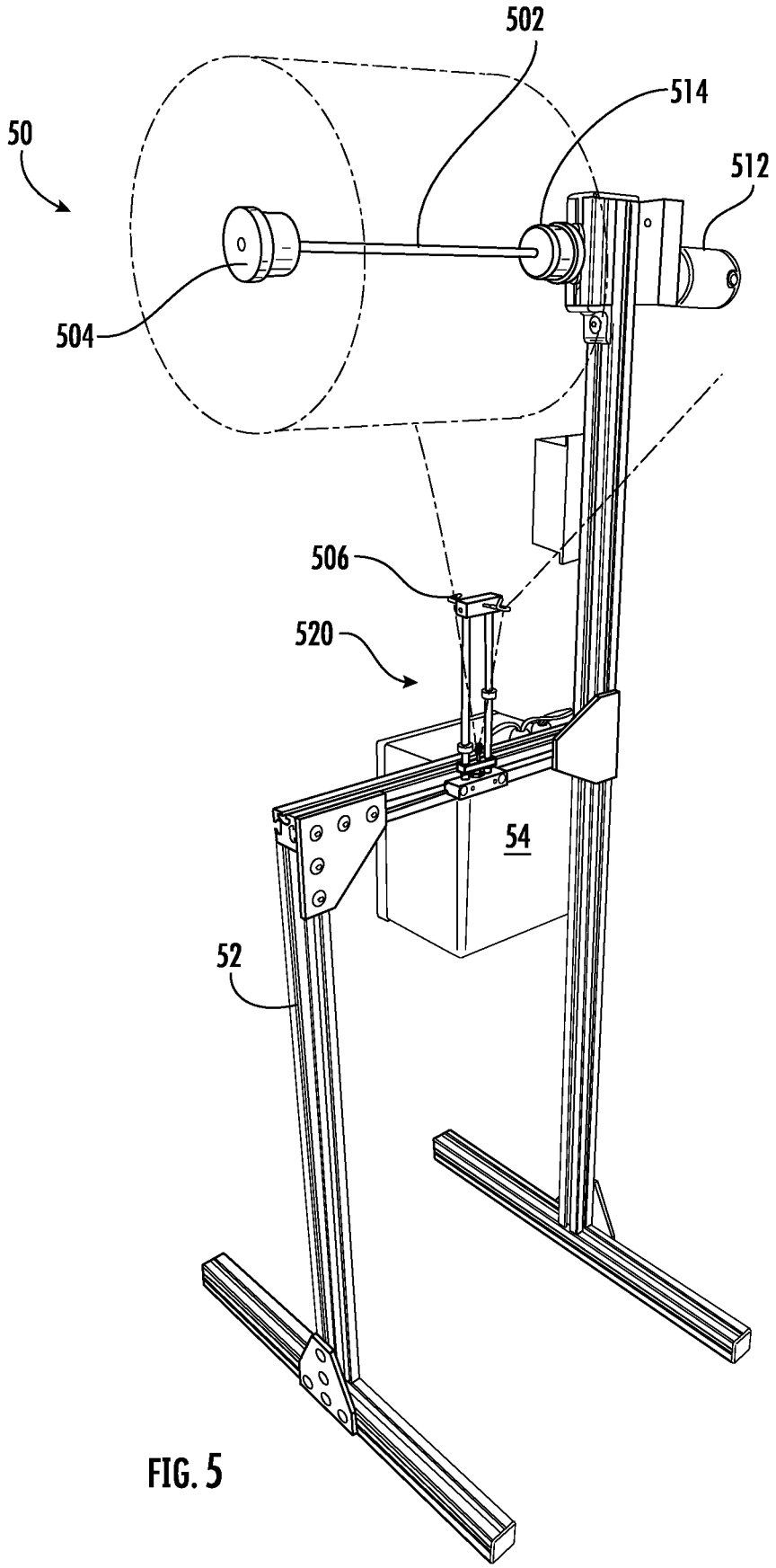
Figure 6:
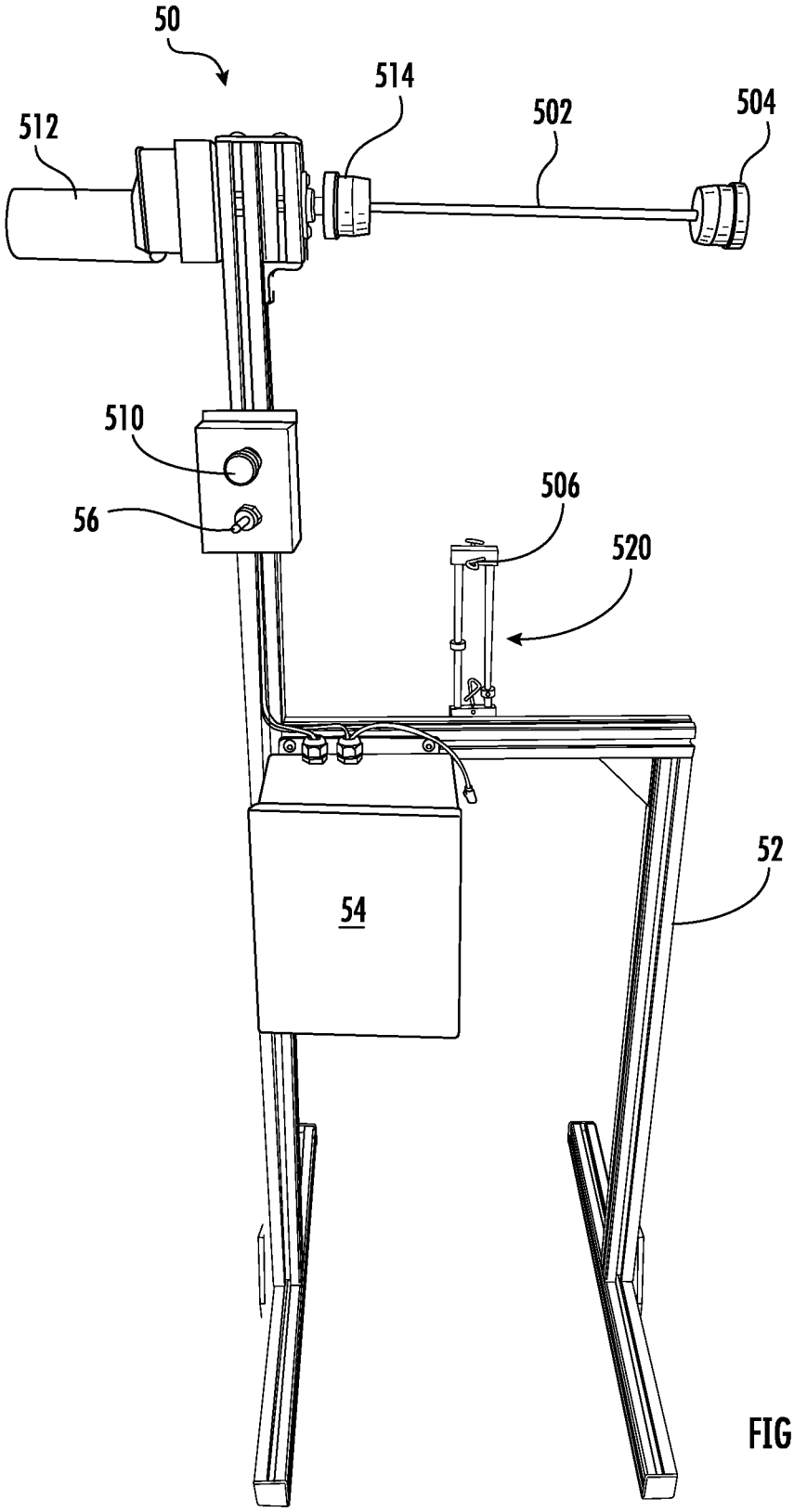

Having thus described embodiments of the invention in general terms, reference will now be made the accompanying drawings, wherein:

FIG. 1 depicts a perspective side view of an exemplary dynamic tension control system 10 in accordance with an embodiment of the invention;

FIG. 2A depicts a perspective front view of an exemplary dynamic tension control system in accordance with an embodiment of the invention;

FIG. 2B depicts an overhead view of an exemplary dynamic tension control system in accordance with an embodiment of the invention;

FIG. 3 depicts a close-up perspective side view of a portion of an exemplary dynamic tension control system in accordance with an embodiment of the invention;

FIG. 4 depicts a close-up perspective side view of a portion of an exemplary dynamic tension control system in accordance with an embodiment of the invention;

FIG. 5 depicts a front perspective view of an exemplary dynamic tension control system in accordance with an embodiment of the invention; and FIG. 6 depicts a rear perspective view of an exemplary dynamic tension control system in accordance with an embodiment of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

As noted, during the assembly of face masks (e.g., surgical masks, medical masks, and/or the like), an ear loop welding machine may be used to create and attach (e.g., weld) ear loops to a piece of mask fabric. For example, the ear loop welding machine may pull linear ear loop material from a roll of linear ear loop material, cut a section of the linear ear loop material, and weld the ends of the section of linear ear loop material onto a piece of mask fabric to form an ear loop. However, when the ear loop welding machine pulls the linear ear loop material from the roll (e.g., a roll on which linear ear loop material is transversely wound under tension), the tension and the amount of material pulled from the roll may vary based on the position on the roll from which the material is pulled. Additionally, the linear ear loop material may twist when passing from the roll to the ear loop welding machine, may be distorted when pulled from the roll (e.g., due to its elasticity), and/or the like. Furthermore, when the ear loop welding machine pulls the linear ear loop material from the roll, the roll may continue to spin and unwind additional material, which may create knots in the linear ear loop material.

Some embodiments described herein provide a dynamic tension control system for narrow fabric, such as linear ear loop material and/or the like. The dynamic tension control system may include a frame for holding components of the dynamic tension control system, a shaft for holding a roll of material (e.g., linear material), a motor for driving the shaft, and a dancer tensioning control system for controlling the motor. In some embodiments, the dancer tensioning control system may include an actuator assembly through which the linear material passes and a sensor (e.g., a proximity sensor) for detecting whether the actuator assembly is proximate to the sensor. When the material is pulled from the roll (e.g., by an ear loop welding machine, a face mask assembly machine, and/or the like), tension is created in the material, which lifts the actuator assembly away from the sensor. In some embodiments, the dynamic tension control system may be configured to command, based on the sensor detecting that the actuator assembly is not proximate to the sensor, the motor to accelerate, which drives the shaft to unwind material from the roll. Additionally, or alternatively, as the motor accelerates and material is unwound from the roll, the tension in the material may be reduced, and the actuator assembly may return, based on the reduced tension, to its original position proximate the sensor. In some embodiments, the dynamic tension control system may be configured to command, based on the sensor detecting that the actuator assembly is proximate to the sensor, the motor to decelerate, which slows and stops the rotation of the shaft and the roll.

By accelerating the motor based on increased tension in the material as sensed by the actuator assembly and sensor, the dynamic tension control system may drive material off the roll in a controlled manner. Additionally, by accelerating and decelerating the motor based on increases and decreases, respectively, in tension in the material, the dynamic tension control system may stabilize the tension and the amount of material coming off the roll. In some embodiments, the dynamic tension control system may include components, such as the actuator assembly, dancer tension control guides, and/or the like, which prevent the material from twisting. Furthermore, by decelerating the motor based on decreases in tension in the material, the dynamic tension control system may prevent the roll from continuing to spin and unwinding additional material, which may prevent knotting of the material.

FIG. 1 depicts a perspective side view of an exemplary dynamic tension control system 10 in accordance with an embodiment of the invention. FIG. 2A depicts a perspective front view of the exemplary dynamic tension control system 10 in accordance with an embodiment of the invention. FIG. 2B depicts an overhead view of the exemplary dynamic tension control system 10 in accordance with an embodiment of the invention. As shown in FIGS. 1, 2A, and 2B, the dynamic tension control system 10 may include a frame 12 configured for positioning and/or supporting elements of the dynamic tension control system 10. For example, and as shown in FIG. 1, the frame 12 may be configured to hold a first roll 100 and/or a second roll 200 in an elevated position with respect to other elements of the dynamic tension control system 10. In some embodiments, the first roll 100 and/or the second roll 200 may include a linear material (e.g., linear ear loop material, narrow fabric, and/or the like) wrapped and/or wound around a spool. For example, the linear material may be transversely wound under tension around the spool.

As shown in FIG. 1, the dynamic tension control system 10 may include a first shaft 102 to pass through and/or support the first roll 100 and a first non-drive-side tube insert 104 to position a spool of the first roll 100 such that the first shaft 102 passes through a center of the spool. As shown in FIGS. 1 and 2A, the dynamic tension control system 10 may include a second shaft 202 (see FIG. 1) and a second non-drive-side tube insert 204 for the second roll 200, which may be similar to the first shaft 102 and the first non-drive-side tube insert 104.

As shown in FIGS. 2A and 2B, the dynamic tension control system 10 may include a second drive-side tube insert 214 on the opposite end of the second roll 200 and/or the second shaft 202 (see FIG. 1) as the second non-drive-side tube insert 204. The second drive-side tube insert 214 may be similar to the first non-drive-side tube insert 104 and/or the second non-drive-side tube insert 204. As shown in FIG. 2B, the dynamic tension control system 10 may include a first drive-side tube insert 114 on the opposite end of the first roll 100 and/or the first shaft 102 (see FIG. 1) as the first non-drive-side tube insert 104. The first drive-side tube insert 114 may be similar to the first non-drive-side tube insert 104, the second non-drive-side tube insert 204, and/or the second drive-side tube insert 214.

In some embodiments, the tube inserts (e.g., the first non-drive-side tube insert 104, the second non-drive-side tube insert 204, the second drive-side tube insert 214, and the first drive-side tube insert 114) may each include an attachment mechanism (e.g., a threaded hole and a set screw) for attaching the tube insert to a shaft (e.g., the first shaft 102 and/or the second shaft 202), thereby preventing the tube insert and a roll (e.g., the first roll 100 and/or the second roll 200) from sliding off an end of the shaft. Additionally, or alternatively, the tube inserts may each include a conical portion, an intermediate portion, and/or an exterior portion (e.g., as shown in FIG. 6). For example, the conical portion may have a lengthwise increasing outer diameter for receiving a spool of a roll, the intermediate portion may have an outer diameter approximately equal to or less than an inner diameter of the spool, and the exterior portion may have an outer diameter greater than an outer diameter of the spool.

As shown in FIGS. 1 and 2A, the dynamic tension control system 10 may include dancer tension control guides 106, 108, and 208 for receiving linear material from the first roll 100 and/or the second roll 200. For example, and as shown in FIGS. 1 and 2A, the dynamic tension control system 10 may include two dancer tension control guides 106 and 108 for receiving the linear material from the first roll 100 and providing the linear material to a first dancer tensioning control system 120. As also shown in FIGS. 1 and 2A, the dynamic tension control system 10 may include one dancer tension control guide 208 for receiving the linear material from the second roll 200 and providing the linear material to a second dancer tensioning control system 220 (e.g., because the second roll 200 is closer to the second dancer tensioning control system 220 than the first roll 100 is to the first dancer tensioning control system 120. In some embodiments, the dynamic tension control system 10 may include fewer or more dancer tension control guides than are shown in FIGS. 1 and 2A.

In some embodiments, the dancer tension control guides 106, 108, and 208 may prevent the linear material from tangling and/or twisting as the linear material passes from the first roll 100 and/or the second roll 200 to the first dancer tensioning control system 120, the second dancer tensioning control system 220, a machine receiving the linear material from the dynamic tension control system 10, and/or the like. Additionally, or alternatively, and as described further herein with respect to FIG. 3, each of the dancer tension control guides 106, 108, and 208 may include a dancer tension control L-guide and an eyelet.

As shown in FIGS. 1 and 2A, the dynamic tension control system 10 may include the first dancer tensioning control system 120 for receiving linear material from the first roll 100 and the second dancer tensioning control system 220 for receiving linear material from the second roll 200. As shown in and described further herein with respect to FIG. 4, the first dancer tensioning control system 120 and the second dancer tensioning control system 220 may be used to control tension in the linear material by providing signals to a tension control housing 14.

As shown in FIGS. 1, 2A, and 2B, the dynamic tension control system 10 may include the tension control housing 14 for receiving signals from the first dancer tensioning control system 120 (see FIGS. 1 and 2A) and/or the second dancer tensioning control system 220 (see FIGS. 1 and 2A) and for controlling, based on the received signals, a first motor 112 (see FIG. 2B) for driving the first shaft 102 and a second motor 212 for driving the second shaft 202. In some embodiments, the dynamic tension control system 10 may include one or more wires for transmitting signals from the first dancer tensioning control system 120 and/or the second dancer tensioning control system 220 to the tension control housing 14, and the tension control housing 14 may include power transformers, relays, motor drives, and/or the like for processing the signals, controlling the first motor 112 and/or the second motor 212, and receiving user input. Additionally, or alternatively, the dynamic tension control system 10 may include a power cord for receiving power from an external power source and providing the power to the tension control housing 14. In some embodiments, the first motor 112 and/or the second motor 212 may be direct-current-powered motors.

In some embodiments, the first motor 112 directly drives the first shaft 102, and the second motor 212 directly drives the second shaft 202. For example, the first shaft 102 may pass through a portion of the frame 12 and insert into the first motor 112, and the second shaft 202 may pass through a portion of the frame 12 and insert into the second motor 212. In some embodiments, a first direct drive internal coupling may couple the first shaft 102 to the frame 12 and maintain a vertical position of the first shaft 102. Additionally, or alternatively, a second direct drive internal coupling may couple the second shaft 202 to the frame 12 and maintain a vertical position of the second shaft 202.

As also shown in FIGS. 1, 2A, and 2B, the tension control housing 14 may include user input devices 110, 210, and 16. For example, the user input device 110 may include a knob for controlling a top speed of the first motor 112, acceleration of the first motor 112, deceleration of the first motor 112, and/or a time period for which the first motor 112 is engaged. Similarly, the user input device 210 may include a knob for controlling a top speed of the second motor 212, acceleration of the second motor 212, deceleration of the second motor 212, and/or a time period for which the second motor 212 is engaged. In some embodiments, the user input device 16 may include a knob, a switch, a button, and/or the like for turning the tension control housing 14 on and off.

FIG. 3 depicts a close-up perspective side view of a portion of the exemplary dynamic tension control system 10 in accordance with an embodiment of the invention. In particular, FIG. 3 depicts the frame 12, the dancer tension control guides 108 and 208, and the upper portions of the first dancer tensioning control system 120 and the second dancer tensioning control system 220.

As shown in FIG. 3, the dancer tension control guide 108 may include a dancer tension control L-guide 116 having a first portion connected to the frame 12 and a second portion including a first eyelet 118. Similarly, the dancer tension control guide 208 may include a dancer tension control L-guide 216 having a first portion connected to the frame 12 and a second portion including a second eyelet 218. In some embodiments, the first eyelet 118 and/or the second eyelet 218 may include and/or be formed of a ceramic material, which may reduce friction, wear, and/or drag as the linear material passes through the first eyelet 118 and/or the second eyelet 218.

In some embodiments, and as shown in FIG. 3, the first and second portions of the dancer tension control L-guides 116 and 216 may form a 90-degree angle. Additionally, or alternatively, the first and second portions of the dancer tension control L-guides 116 and 216 may be configured to form another angle based on an orientation and/or shape of the frame 12 and/or based on effective prevention of tangling and/or twisting of the linear material.

As shown in FIG. 3, the first dancer tensioning control system 120 may include a first top block assembly 122 and a first upper guide 124 extending outward from the first top block assembly 122. Similarly, the second dancer tensioning control system 220 may include a second top block assembly 222 and a second upper guide 224 extending outward from the second top block assembly 222. In some embodiments, the first upper guide 124 and the second upper guide 224 are formed from a flexible and/or manually-bendable material having a low-friction exterior surface, which may reduce friction, wear, and/or drag as the linear material passes through the first upper guide 124 and the second upper guide 224 and may prevent tangling and/or twisting of the linear material.

As shown in FIG. 3, the first dancer tensioning control system 120 may include a first bottom block assembly 126, a first proximity sensor 128 on the first bottom block assembly 126, and a first actuator assembly 130. Similarly, the second dancer tensioning control system 220 may include a second bottom block assembly 226, a second proximity sensor (not shown) on the second bottom block assembly 226, and a second actuator assembly 230. As described herein with respect to FIG. 4, the first proximity sensor 128 (see FIG. 3) may detect whether the first actuator assembly 130 is proximate to the first proximity sensor 128, and the second proximity sensor may detect whether the second actuator assembly 230 is proximate to the second proximity sensor. In some embodiments, the first bottom block assembly 126 (see FIG. 3) and the second bottom block assembly 226 (see FIG. 3) may be mounted to a portion of the frame 12.

In some embodiments, the linear material may pass through the first eyelet 118 as shown in FIG. 3, downward towards a lower portion of the first dancer tensioning control system 120 (see FIG. 4), and then upwards through the first upper guide 124 as shown in FIG. 3. Additionally, or alternatively, the linear material may pass through the second eyelet 218, downward towards a lower portion of the second dancer tensioning control system 220 (see FIG. 4), and then upwards through the second upper guide 224 as shown in FIG. 3. After passing through the first upper guide 124 and the second upper guide 224, the linear materials may pass through one or more other eyelets or guides to a machine (e.g., an ear loop welding machine, a face mask assembly machine, and/or the like) which may pull the linear material.

FIG. 4 depicts a close-up perspective side view of a portion of the exemplary dynamic tension control system 10 in accordance with an embodiment of the invention. In particular, FIG. 4 depicts the frame 12, the dancer tension control guides 108 and 208, and portions of the first dancer tensioning control system 120 and the second dancer tensioning control system 220.

As shown in FIG. 4, the first dancer tensioning control system 120 may include the first actuator assembly 130 including a first eyelet 132, first guide rods 134, first variable tensioners 136, first adjustable mechanical upper limits 138, and a first safety stop proximity sensor 140. As also shown in FIG. 4, the second dancer tensioning control system 220 may include the second actuator assembly 230 including a second eyelet 232, second guide rods 234, second variable tensioners 236, second adjustable mechanical upper limits 238, and a second safety stop proximity sensor 240.

In some embodiments, the first eyelet 132 and/or the second eyelet 232 may be attached to the first actuator assembly 130 and/or the second actuator assembly 230, respectively, by passing through holes in the top of the first actuator assembly 130 and/or the second actuator assembly 230 and being secured in the holes via an attachment mechanism (e.g., a threaded hole and a set screw) as shown in FIG. 4 by the central hole in the first actuator assembly 130 and/or the second actuator assembly 230. Additionally, or alternatively, the first eyelet 132 and/or the second eyelet 232 may be include and/or be formed of a ceramic material, which may reduce friction, wear, and/or drag as the linear material passes through the first eyelet 132 and/or the second eyelet 232.

In some embodiments, and as shown in FIG. 4 by the two larger holes, portions of the first actuator assembly 130 and/or the second actuator assembly 230 may be removed to adjust the weight of the first actuator assembly 130 and/or the second actuator assembly 230, which may reduce the amount of tension created in the linear element by the first actuator assembly 130 and/or the second actuator assembly 230. Additionally, or alternatively, weight may be added to the first actuator assembly 130 and/or the second actuator assembly 230 to increase the amount of tension created in the linear element by the first actuator assembly 130 and/or the second actuator assembly 230.

In some embodiments, and as shown in FIG. 4 with respect to the second dancer tensioning control system 220, the first actuator assembly 130 and the second actuator assembly 230 may move up and down along the first guide rods 134 and the second guide rods 234, respectively. For example, as a machine (e.g., an ear loop welding machine, a face mask assembly machine, and/or the like) pulls linear material from the second roll 200 (see FIGS. 1, 2A, and 2B), tension in the linear material increases, and the linear material, which passes through the second eyelet 232, lifts the second actuator assembly 230 upward along the second guide rods 234.

In some embodiments, when the first actuator assembly 130 is lifted upward along the first guide rods 134, the first proximity sensor 128 (see FIG. 3) may detect that the first actuator assembly 130 is not proximate to the first proximity sensor 128 and may transmit, based on detecting that the first actuator assembly 130 is not proximate to the first proximity sensor 128, a signal to the tension control housing 14 (see FIGS. 1, 2A, and 2B). The tension control housing 14 may be configured to command, based on receiving the signal from the first proximity sensor 128, the first motor 112 (see FIG. 2B) to drive the first shaft 102 (see FIG. 1), which rotates the first roll 100 (see FIG. 1) to unwind linear material from the first roll 100.

Additionally, or alternatively, as the first motor 112 accelerates and linear material is unwound from the first roll 100, the tension in the linear material may be reduced, and the first actuator assembly 130 may return, based on the reduced tension, to its original position proximate the first proximity sensor 128. The first proximity sensor 128 may detect that the first actuator assembly 130 is proximate to the first proximity sensor 128 and may stop transmitting, based on detecting that the first actuator assembly 130 is proximate to the first proximity sensor 128, the signal to the tension control housing 14. The tension control housing 14 may be configured to command, based on not receiving the signal from the first proximity sensor 128, the first motor 112 to decelerate, which slows and stops the rotation of the first shaft 102 and the first roll 100.

Similarly, when the second actuator assembly 230 is lifted upward along the second guide rods 234, the second proximity sensor may detect that the second actuator assembly 230 is not proximate to the second proximity sensor and may transmit, based on detecting that the second actuator assembly 230 is not proximate to the second proximity sensor, a signal to the tension control housing 14 (see FIGS. 1, 2A, and 2B). The tension control housing 14 may be configured to command, based on receiving the signal from the second proximity sensor, the second motor 212 (see FIGS. 2A and 2B) to drive the second shaft 202 (see FIG. 1), which rotates the second roll 200 (see FIGS. 1, 2A, and 2B) to unwind linear material from the second roll 200.

Additionally, or alternatively, as the second motor 212 accelerates and linear material is unwound from the second roll 200, the tension in the linear material may be reduced, and the second actuator assembly 230 may return, based on the reduced tension, to its original position proximate the second proximity sensor. The second proximity sensor may detect that the second actuator assembly 230 is proximate to the second proximity sensor and may stop transmitting, based on detecting that the second actuator assembly 230 is proximate to the second proximity sensor, the signal to the tension control housing 14. The tension control housing 14 may be configured to command, based on not receiving the signal from the second proximity sensor, the second motor 212 to decelerate, which slows and stops the rotation of the second shaft 202 and the second roll 200.

As noted and as shown in FIG. 4, the first dancer tensioning control system 120 may include the first variable tensioners 136 on the first guide rods 134, and the second dancer tensioning control system 220 may include the second variable tensioners 236 on the second guide rods 234. In some embodiments, the position of the first variable tensioners 136 on the first guide rods 134 may be adjusted (e.g., manually) up and down to increase tension in the linear material when the first actuator assembly 130 reaches the position of the first variable tensioners 136. Similarly, the position of the second variable tensioners 236 on the second guide rods 234 may be adjusted (e.g., manually) up and down to increase tension in the linear material when the second actuator assembly 230 reaches the position of the second variable tensioners 236. In some embodiments, the first variable tensioners 136 and/or the second variable tensioners 236 may include rubber O-rings.

As noted and as shown in FIG. 4, the first dancer tensioning control system 120 may include the first adjustable mechanical upper limits 138 on the first guide rods 134, and the second dancer tensioning control system 220 may include the second adjustable mechanical upper limits 238 on the second guide rods 234. In some embodiments, the position of the first adjustable mechanical upper limits 138 on the first guide rods 134 may be adjusted up and down to provide a mechanical upper limit for the first actuator assembly 130. Similarly, the position of the second adjustable mechanical upper limits 238 on the second guide rods 234 may be adjusted up and down to provide a mechanical upper limit for the second actuator assembly 230. In some embodiments, the first adjustable mechanical upper limits 138 and/or the second adjustable mechanical upper limits 238 may include an attachment mechanism (e.g., a threaded hole and a set screw) for positioning the first adjustable mechanical upper limits 138 and/or the second adjustable mechanical upper limits 238 on the first guide rods 134 and/or the second guide rods 234, respectively.

As noted, and as shown in FIG. 4, the first dancer tensioning control system 120 may include the first safety stop proximity sensor 140, and the second dancer tensioning control system 220 may include the second safety stop proximity sensor 240. In some embodiments, the first safety stop proximity sensor 140 and/or the second safety stop proximity sensor 240 may be configured to detect whether the first actuator assembly 130 and/or the second actuator assembly 230, respectively, is proximate to the first safety stop proximity sensor 140 and/or the second safety stop proximity sensor 240. Additionally, or alternatively, the first safety stop proximity sensor 140 and/or the second safety stop proximity sensor 240 may be configured to transmit, based on detecting that the first actuator assembly 130 and/or the second actuator assembly 230, respectively, is proximate to the first safety stop proximity sensor 140 and/or the second safety stop proximity sensor 240, a signal to the tension control housing 14. The tension control housing 14 may be configured to command, based on receiving a signal from the first safety stop proximity sensor 140 and/or the second safety stop proximity sensor 240, the first motor 112 and/or the second motor 212, respectively, to decelerate, which slows and stops the rotation of the first shaft and/or the second shaft 202 and the first roll 100 and/or the second roll 200. In some embodiments, the vertical positions of the first safety stop proximity sensor 140 and/or the second safety stop proximity sensor 240 with respect to the bottom block assemblies 126 and 226 (see FIG. 3) may be adjustable (e.g., by adjusting the positions of the bottom block assemblies 126 and 226 within the frame 12, by adjusting the positions of the first safety stop proximity sensor 140 and/or the second safety stop proximity sensor 240 within the frame 12, and/or the like).

FIG. 5 depicts a front perspective view of an exemplary dynamic tension control system 50 in accordance with an embodiment of the invention. FIG. 6 depicts a rear perspective view of the exemplary dynamic tension control system 50 in accordance with an embodiment of the invention. In some embodiments, the dynamic tension control system 50 may be similar to and/or have characteristics of the dynamic tension control system 10 of FIGS. 1, 2A, 2B, 3, and 4. For example, the dynamic tension control system 50 may be similar to and/or have characteristics of the portions of the dynamic tension control system 10 associated with either the first roll 100 or the second roll 200.

As shown in FIGS. 5 and 6, the dynamic tension control system 50 may include a frame 52, a tension control housing 54, user input devices 510 and 56 (see FIG. 6), a shaft 502, a non-drive-side tube insert 504, an input-side upper guide 506, a motor 512, a drive-side tube insert 514, and a dancer tensioning control system 520. In some embodiments, the frame 52, the tension control housing 54, the user input devices 510 and 56, the shaft 502, the non-drive side tube insert 504, the motor 512, the drive-side tube insert 514, and the dancer tensioning control system 520 may be similar to and/or have characteristics of the frame 12, the tension control housing 14, the user input devices 110 and 16, the first shaft 102 or the second shaft 202, the first non-drive side tube insert 104 or the second non-drive side tube insert 204, the first motor 112 or the second motor 212, the first drive-side tube insert 114 or the second drive-side tube insert 214, and the first dancer tensioning control system 120 or the second dancer tensioning control system 220, respectively, of the dynamic tension control system 10 of FIGS. 1, 2A, 2B, 3, and 4. Although not shown in FIGS. 5 and 6, the dynamic tension control system 50 may also include other components similar to and/or having characteristics of other components of the dynamic tension control system 10 of FIGS. 1, 2A, 2B, 3, and 4, such as the dancer tension control guides 108 and 208, the first safety stop proximity sensor 140, the second safety stop proximity sensor 240, the first variable tensioners 136, the second variable tensioners 236, and/or the like.

As shown by the dashed lines in FIG. 5, a roll of linear material may be positioned on the shaft 502 between the non-drive-side tube insert 504 and the drive-side tube insert 514, and the linear material may pass from the roll downward through the input-side upper guide 506 to an eyelet of the dancer tensioning control system 520 and upward through an upper guide of the dancer tensioning control system 520. In some embodiments, the input-side upper guide 506 may be formed from a flexible and/or manually-bendable material having a low-friction exterior surface, which may reduce friction, wear, and/or drag as the linear material passes through the input-side upper guide 506 and may prevent tangling and/or twisting of the linear material.

As shown in FIGS. 5 and 6, the non-drive-side tube insert 504 and/or the drive-side tube insert 514 may each include a conical portion, an intermediate portion, and/or an exterior portion. For example, and as shown in FIG. 6, the conical portion may have a lengthwise increasing outer diameter for receiving a spool of a roll, the intermediate portion may have an outer diameter approximately equal to or less than an inner diameter of the spool, and the exterior portion may have an outer diameter greater than an outer diameter of the spool.

As noted, in some embodiments, the dancer tensioning control system 520 may be similar to and/or have characteristics of the first dancer tensioning control system 120 or the second dancer tensioning control system 220. For example, the dancer tensioning control system 520 may include a top block assembly, an upper guide, a bottom block assembly, a proximity sensor, an actuator assembly, an eyelet, guide rods, variable tensioners, adjustable mechanical upper limits, and/or the like. Additionally, or alternatively, the components of the dancer tensioning control system 520 may perform functions similar to the functions described herein with respect to the first dancer tensioning control system 120 or the second dancer tensioning control system 220.

In some embodiments, the dynamic tension control system 50 may perform functions similar to the functions described herein with respect to the dynamic tension control system 10. For example, when the actuator assembly of the dancer tensioning control system 520 is lifted upward along the guide rods, the proximity sensor may detect that the actuator assembly is not proximate to the proximity sensor and may transmit, based on detecting that the actuator assembly is not proximate to the proximity sensor, a signal to the tension control housing 54. The tension control housing 54 may be configured to command, based on receiving the signal from the proximity sensor, the motor 512 to drive the shaft 502, which rotates a roll of linear material to unwind linear material from the roll.

Additionally, or alternatively, as the motor accelerates and linear material is unwound from the roll, the tension in the linear material may be reduced, and the actuator assembly may return, based on the reduced tension, to its original position proximate the proximity sensor. The proximity sensor may detect that the actuator assembly is proximate to the proximity sensor and may stop transmitting, based on detecting that the actuator assembly is proximate to the proximity sensor, the signal to the tension control housing 54. The tension control housing 54 may be configured to command, based on not receiving the signal from the proximity sensor, the motor to decelerate, which slows and stops the rotation of the shaft 502 and the roll.

Although many embodiments of the present invention have just been described above, the present invention may be embodied in many different forms and should not be construed as limited to the embodiments set forth herein; rather, these embodiments are provided so that this disclosure will satisfy applicable legal requirements. Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more," even though the phrase "one or more" is also used herein. Like numbers refer to like elements throughout.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A dynamic tension control system, the system comprising:
- a shaft for holding a roll of material;
- a motor for driving the shaft; and
- a dancer tensioning control system comprising:
  - an actuator assembly for receiving the material; and
  - a sensor configured to:
    - detect whether the actuator assembly is proximate the sensor;
    - transmit, based on detecting that the actuator assembly is not proximate the sensor, a signal; and
    - stop transmitting, based on detecting that the actuator assembly is proximate the sensor, the signal;
- wherein the dynamic tension control system is configured to:
  - command, based on receiving the signal from the sensor, the motor to accelerate; and
  - command, based on stopping receiving the signal from the sensor, the motor to decelerate.

2. The dynamic tension control system of claim 1, comprising a frame configured for positioning and supporting the shaft, the motor, and the dancer tensioning control system.

3. The dynamic tension control system of claim 1, comprising:
- a non-drive-side tube insert to position a spool of the roll such that the shaft passes through a center of the spool; and
- a drive-side tube insert to position the spool of the roll such that the shaft passes through the center of the spool.

4. The dynamic tension control system of claim 3, wherein:
- the non-drive-side tube insert comprises a first attachment mechanism for attaching the non-drive-side tube insert to the shaft to prevent the non-drive-side tube insert and the roll from sliding off the shaft; and
- the drive-side tube insert comprises a second attachment mechanism for attaching the drive-side tube insert to the shaft to prevent the drive-side tube insert and the roll from sliding off the shaft.

5. The dynamic tension control system of claim 3, wherein:
- the non-drive-side tube insert comprises a first conical portion, a first intermediate portion, and a first exterior portion; and
- the drive-side tube insert comprises a second conical portion, a second intermediate portion, and a second exterior portion.

6. The dynamic tension control system of claim 5, wherein:
- the first conical portion and the second conical portion have lengthwise increasing outer diameters for receiving the spool;
- the first intermediate portion and the second intermediate portion have outer diameters equal to or less than an inner diameter of the spool; and
- the first exterior portion and the second exterior portion have outer diameters greater than an outer diameter of the spool.

7. The dynamic tension control system of claim 1, comprising one or more dancer tension control guides for receiving the material from the roll and providing the material to the dancer tensioning control system.

8. The dynamic tension control system of claim 1, comprising a user input device for controlling at least one of a top speed of the motor, acceleration of the motor, deceleration of the motor, or a time period for which the motor drives the shaft.

9. The dynamic tension control system of claim 1, wherein the dancer tensioning control system comprises:

a top block assembly; and an upper guide assembly extending outward from the top block assembly, wherein the material passes through the actuator assembly and then through the upper guide assembly.

10. The dynamic tension control system of claim 9, wherein the dancer tensioning control system comprises a bottom block assembly, and wherein the sensor is positioned on the bottom block assembly.

11. The dynamic tension control system of claim 10, wherein the dancer tensioning control system comprises guide rods extending between the bottom block assembly and the top block assembly, and wherein the actuator assembly moves along the guide rods.

12. The dynamic tension control system of claim 1, comprising:

another shaft for holding another roll of material;

another motor for driving the other shaft; and another dancer tensioning control system comprising:

another actuator assembly for receiving the material from the other roll;

another sensor configured to:

detect whether the other actuator assembly is proximate the other sensor;

transmit, based on detecting that the other actuator assembly is not proximate the other sensor, another signal; and stop transmitting, based on detecting that the other actuator assembly is proximate the other sensor, the other signal;

wherein the dynamic tension control system is configured to:

command, based on receiving the other signal from the other sensor, the other motor to accelerate; and command, based on stopping receiving the other signal from the other sensor, the other motor to decelerate.

13. A dynamic tension control system, the system comprising:

a shaft for holding a roll of linear material;

a motor for driving the shaft; and a dancer tensioning control system comprising:

a top block assembly;

a bottom block assembly below the top block assembly;

guide rods extending between the bottom block assembly and the top block assembly;

an actuator assembly movably positioned on the guide rods between the bottom block assembly and the top block assembly, wherein the actuator assembly comprises an eyelet for receiving the linear material; and a proximity sensor positioned on the bottom block assembly, wherein the proximity sensor is configured to:

detect whether the actuator assembly is proximate the proximity sensor;

transmit, based on detecting that the actuator assembly is not proximate the proximity sensor, a signal; and stop transmitting, based on detecting that the actuator assembly is proximate the proximity sensor, the signal;

wherein the dynamic tension control system is configured to:

command, based on receiving the signal from the proximity sensor, the motor to accelerate; and command, based on stopping receiving the signal from the proximity sensor, the motor to decelerate.

14. The dynamic tension control system of claim 13, wherein the dancer tensioning control system comprises an upper guide assembly extending outward from the top block assembly, wherein the linear material passes through the eyelet of the actuator assembly and then through the upper guide assembly.

15. The dynamic tension control system of claim 13, wherein the dancer tensioning control system comprises variable tensioners on the guide rods, wherein a position of the variable tensioners on the guide rods is adjustable to increase tension in the linear material when the actuator assembly reaches the position of the variable tensioners on the guide rods.

16. The dynamic tension control system of claim 13, wherein the dancer tensioning control system comprises adjustable mechanical upper limits on the guide rods, wherein a position of the adjustable mechanical upper limits on the guide rods is adjustable to provide a mechanical upper limit for the actuator assembly.

17. The dynamic tension control system of claim 13, wherein:

the dancer tensioning control system comprises a safety stop proximity sensor configured to:

detect whether the actuator assembly is proximate the safety stop proximity sensor; and transmit, based on detecting that the actuator assembly is proximate the safety stop proximity sensor, another signal; and the dynamic tension control system is configured to command, based on receiving the other signal from the safety stop proximity sensor, the motor to decelerate.

18. A dynamic tension control system, the system comprising:

a shaft for holding a roll of linear material;

a motor for directly driving the shaft;

a dancer tensioning control system comprising:

an actuator assembly comprising an eyelet for receiving the linear material; and a proximity sensor positioned below the actuator assembly, wherein the proximity sensor is configured to:

detect whether the actuator assembly is proximate the proximity sensor;

transmit, based on detecting that the actuator assembly is not proximate the proximity sensor, a signal; and stop transmitting, based on detecting that the actuator assembly is proximate the proximity sensor, the signal;

a frame for positioning and supporting the shaft, the motor, and the dancer tensioning control system; and a dancer tension control guide positioned on the frame, wherein the dancer tension control guide receives the linear material from the roll and provides the linear material to the dancer tensioning control system;

wherein the dynamic tension control system is configured to:

command, based on receiving the signal from the proximity sensor, the motor to accelerate; and command, based on stopping receiving the signal from the proximity sensor, the motor to decelerate.

19. The dynamic tension control system of claim 18, wherein the dancer tension control guide comprises a dancer tension control L-guide and an eyelet, wherein the linear material passes through the eyelet, and wherein the eyelet comprises a ceramic material.

20. The dynamic tension control system of claim 18, wherein the dancer tensioning control system comprises another dancer tension control guide for receiving the linear material from the dancer tension control guide.

* * * * *